US006674068B1

(12) United States Patent
Kammei

(10) Patent No.: US 6,674,068 B1
(45) Date of Patent: Jan. 6, 2004

(54) TIME-OF-FLIGHT (TOF) MASS SPECTROMETER AND METHOD OF TOF MASS SPECTROMETRIC ANALYSIS

(75) Inventor: Yoshihiro Kammei, Tokyo (JP)

(73) Assignee: Jeol Ltd., Tokyo (JP)

( * ) Notice: Subject to any disclaimer, the term of this patent is extended or adjusted under 35 U.S.C. 154(b) by 0 days.

(21) Appl. No.: 09/561,193

(22) Filed: Apr. 27, 2000

(30) Foreign Application Priority Data

Apr. 28, 1999 (JP) ..... 11-121016
Mar. 15, 2000 (JP) ..... 2000-071925

(51) Int. Cl.[7] ..... H01J 49/40

(52) U.S. Cl. ..... 250/287; 250/283; 250/286; 250/282; 250/288; 250/397

(58) Field of Search ..... 250/283, 287, 250/286, 282, 288, 397

(56) References Cited

U.S. PATENT DOCUMENTS 5,117,107 A 5/1992 Guilhaus et al. ..... 250/287
5,591,969 A * 1/1997 Park et al. ..... 250/283
5,614,711 A * 3/1997 Li et al. ..... 250/282
6,229,142 B1 * 5/2001 Bateman et al. ..... 250/282

OTHER PUBLICATIONS

"Resolution and Spectral–line Shapes in the Reflecting Time–of–flight Mass Spectrometer with Orthogonally Injected Ions", V. V. Laiko and F. F. Dodonov, *Rapid Communications in Mass Spectrometry*, vol. 8, pp. 720–726 (1994).

* cited by examiner

*Primary Examiner*—John R. Lee
*Assistant Examiner*—Zia R. Hashmi
(74) *Attorney, Agent, or Firm*—Webb Ziesenheim Logsdon Orkin & Hanson, P.C.

(57) ABSTRACT

There is disclosed a time-of-flight (TOF) mass spectrometer using microchannel plates (MCPs), that are prevented from saturating even if strong ion pulses hit the microchannel plates. Usually, the saturation would result in a dead time, removing parts of the produced mass spectrum and shortening the lifetimes of the microchannel plates. An intermediate ion detector is mounted at the spatial focusing point of a reflectron TOF-MS spectrometer portion to measure the current values of ion pulses arriving from an external ion source, as well as the elapsed times since start of travel of the ion pulses. Information obtained by the measurement is fed back to the final ion detector. Thus, the gain of the final ion detector is controlled before the ion pulses reach the final ion detector. This prevents saturation of the final ion detector. The invention can also be applied to a TOF mass spectrometer using pulsed ionization and to an electrostatic sector field TOF mass spectrometer.

16 Claims, 4 Drawing Sheets threshold level
$P_1$
$P_2$
$P_3$
$t_D$
t

TIME-OF-FLIGHT (TOF) MASS SPECTROMETER AND METHOD OF TOF MASS SPECTROMETRIC ANALYSIS

BACKGROUND OF THE INVENTION

1. Field of the Invention

The present invention relates to a time-of-flight (TOF) mass spectrometer and, more particularly, to a TOF mass spectrometer having an ion detector that is prevented from saturating.

2. Description of the Related Art

An orthogonal acceleration time-of-flight mass spectrometer (OA/TOF-MS) is an instrument for performing a mass analysis by producing ions continuously by an ion source, introducing the ion beam emitted from the ion source into an ion reservoir, accelerating the ions in the ion reservoir in a pulsed manner in a direction orthogonal to the direction of introduction of the ions, and measuring the flight time from the instant when the ions are accelerated to the instants when the accelerated ion pulses are detected by a final ion detector.

FIG. 1 schematically shows the configuration of an OA/TOF-MS employing an electrostatic reflecting mirror. Now let us consider the instrument as shown in FIG. 1 that is polarity positive. It has an external ion source 1 for producing positive ions continuously by electron impact (EI), chemical ionization (CI), fast atom bombardment (FAB), electrospray ionization (ESI), atmospheric-pressure chemical ionization (APCI), inductively coupled plasma-mass spectrometry (ICP-MS), or other ionization techniques.

An ion beam emitted from the external ion source 1 at a positive accelerating potential $V_1$ is focused in the z direction by a focusing lens 2 to which a positive potential $V_F$ is applied. Then, the beam is admitted into an ion reservoir 3 having an effective length $y_0$. The ion reservoir 3 is equipped with a push-out plate 4. The reservoir 3 is also provided with an ion extraction grid 5 and an exit grid 6 that are located opposite to the push-out plate 4. The extraction grid 5 is at ground potential. The exit grid 6 is at a negative potential. Thus, an electric field is developed to push out ions in a direction (z direction) orthogonal to the direction of introduction of the ion beam (y direction).

If a push-out pulse 7 consisting of a positive voltage of $2V_s$ is applied to the push-out plate 4, a field gradient is momentarily produced in a region 8 that extends from the push-out plate 4 to the exit grid 6 across the ion extraction grid 5. This region 8 is known as the two-stage accelerating region. As a result, the ions in the ion reservoir 3 are simultaneously accelerated in the z direction and expelled as ion pulses. The ions are reflected by a mirror portion 9 mounted at an opposite position. Then, the ions travel toward a final ion detector 10 consisting of microchannel plates (MCPs) or the like.

Strictly, the ions have y-direction velocity components given when they are introduced into the ion reservoir 3. Therefore, if the ions undergo z-direction forces by the electric fields produced in the two-stage accelerating region 8, i.e., between the push-out plate 4 and the ion extraction grid 5 and between the grid 5 and the exit grid 6, the direction of travel is shifted to the y direction slightly from the z direction.

When the ions undergo the above-described acceleration, a given energy corresponding to the potential difference between the push-out plate 4 and the exit grid 6 is uniformly imparted to the ions and so ions of smaller masses have greater velocities and ions of greater masses have smaller velocities when the acceleration ends. Because of the velocity variations as described above, the ions are mass-dispersed while they are traveling through a reflectron TOF-MS spectrometer portion 12 placed at a negative potential $V_2$ by a mass spectrometer portion power supply 11. Consequently, the ions are dispersed into ion pulses according to mass. As the ions having smaller mass-to-charge ratios (m/z; m: mass, z: valence number) reach the final ion detector 10 sooner, mass dispersion occurs. Thus, the ions can be observed as a mass spectrum.

A tandem MCP (a couple of MCPS), usually employed as an ion detector for TOF-MS to maintain an appropriate secondary electron multiple gain ranging $10^4$–$10^6$, is made of millions of very thin capillary tubes of conductive glass bundled together, each having a diameter of 10 to 25 $\mu$m and a length of 0.24 to 1.0 mm. Each tube acts as a secondary electron multiplier. Since secondary electrons travel only less than 1.0 mm in the microchannel plate, the plate can respond at a high speed of 1 nanosecond (ns) to applied pulsed, charged particles. On the other hand, where a photomultiplier tube or secondary electron multiplier tube where secondary electrons travel about several centimeters is used, a response time of about 5 ns is necessary.

Generally, the mass resolution of a time-of-flight mass spectrometer is given by:

$$R = \frac{M}{\Delta M} = \frac{t_{TOF}}{2 \cdot \Delta t} \tag{1}$$

where M is mass in dalton (Da), ΔM is a mass difference, $t_{TOF}$ is the flight time of ion $M^+$, and Δt is the width of an ion pulse. The ion pulse width Δt is independent of the location on the Z-axis where a measurement is made. As the width in the final ion detector becomes narrowest, the mass resolution R is optimum. Accordingly, the width of the incident ion pulse is ideally equal to the width of the output signal from the secondary electron multiplier in the final ion detector. In practice, however, it is inevitable that the final ion detector itself will produce time spread, adding to the pulse width Δt in the denominator of Eq. (1).

Normally, in a high-resolution time-of-flight mass spectrometer, the pulse width Δt is about 5 ns at the entrance of the final ion detector. Since the time spread is roughly 5 ns as mentioned above where a photomultiplier or a secondary electron multiplier is used, the mass resolution R of the high-resolution TOF mass spectrometer is greatly affected. For example, when ions impinge on the final ion detector, consider the pulse width (t=5 ns) When leaving the final ion detector, the pulse width is temporally spread out to be (t=5+5=10 ns) Consequently, the mass resolution of the TOF mass spectrometer drops to ½. For this reason, microchannel plates (MCPs) capable of responding in less than 1 ns are often used, especially in high-resolution TOF mass spectrometers.

In this case, however, the problem with the use of microchannel plates (MCPs) is that the linear range of output/input is limited in principle. In particular, the linearity of a microchannel plate is determined by a strip current value intrinsic in the microchannel plate. The linear range of output/input is narrower and indicated by three digits; in the case of a secondary electron multiplier, the range is wider and indicated by 5 digits. The strip current also acts to neutralize the electric charge of secondary electrons produced by the microchannel plate. It is known that the microchannel plate starts to saturate when the average output current of the microchannel plate is 5% to 6% of the strip current.

Of course, where the gain of the microchannel plate is set high, secondary electron-saturation of the microchannel plate tends to occur. Once such saturation takes place, the time taken to neutralize secondary electrons by the strip current is on the order of microseconds ($\mu$s). If more secondary electrons are produced, the time is increased. The microchannel plate is insensitive, i.e., in a dead-time state, until the neutralization is completed. The outputs indicative of peaks of ions impinging during this insensitive period are zero. Peaks indicating these ions are absent from the mass spectrum. If the microchannel plate saturates repeatedly, deterioration of the microchannel plate is accelerated, thus shortening the lifetime.

As an example, it is assumed that a dead time of 1 $\mu$s occurs. We now discuss what mass spectral range is absent from the produced ion spectrum. Where a monovalent ion having a mass of M Da (dalton) is accelerated by V volts and travels L cm through a free space, the flight time is approximated by:

$$t_{TOF} \cong 0.72 \cdot L\sqrt{\left(\frac{M}{V}\right)} \tag{2}$$

where L is flight distance in cm, M is the mass of the ion in Da, and V is the accelerating voltage (in volts) for the ion.

Where a monovalent ion is accelerated with V=3000 volts, if flight distance L=100 cm, then the flight times $t_{TOF}$ of ions with masses M of 99 Da and 100 Da, respectively, are approximately 13.08 $\mu$s and 13.14 $\mu$s, respectively. The fight time difference per dalton is about 60 $\mu$s. In this mass range, 1 $\mu$s corresponds to a mass range of about 16.7 Da. Similarly, the flight times $t_{TOF}$ of ions having masses of 299 Da and 300 Da, respectively, are approximately 22.73 $\mu$s and 22.77 $\mu$s, respectively. The time difference per dalton is about 40 ns. In this mass range, 1 $\mu$s corresponds to a mass range of about 25 Da. Therefore, a dead time on the order of microseconds due to saturation of the microchannel plate gives rise to absence of peaks in a considerably wide mass range from a mass spectrum.

SUMMARY OF THE INVENTION

In view of the foregoing circumstances, it is an object of the present invention to provide a time-of-flight (TOF) mass spectrometer which has microchannel plates (MCPs) and which can prevent difficulties that would normally be caused where intense ion pulses impinge on the microchannel plates to thereby saturate the microchannel plates, whereby the resulting dead time produces deficient mass spectra and shortens the lives of the microchannel plates.

This object is achieved in accordance with the teachings of the present invention by a time-of-flight (TOF) mass spectrometer comprising: an ion source for producing ion pulses; a time-of-flight mass spectrometer region through which the ion pulses emitted from the ion source travel; a final ion detector for detecting incident ion pulses which have traveled a given distance through said region and have been dispersed into plural ion pulses according to their own flight velocities; a flight time-measuring portion for measuring times taken for the dispersed ion pulses to reach the final ion source since departure from the ion source; an intermediate ion detector mounted in said time-of-flight mass spectrometer portion and acting to detect current values of said dispersed ion pulses before reaching the final ion detector; a measuring means for measuring elapsed times since the dispersed ion pulses reaching the intermediate ion detector have left the ion source; a computer means for forecasting the flight time at which the dispersed ion pulses will reach the final ion detector based on the measured elapsed times; and a saturation-preventing circuit for controlling the gain of the final ion detector according to the current values of the dispersed ion pulses detected by the intermediate ion detector and according to the forecast times of arrival of the dispersed ion pulses at the final ion detector in synchronism with arrival of the dispersed ion pulses to prevent the dispersed ion pulses from saturating the final ion detector.

Preferably, according to the present invention, the aforementioned intermediate ion detector is located at a spatial focusing point for ions in the time-of-flight mass spectrometer portion.

The aforementioned saturation-preventing circuit is characterized in that it switches the gain of the final ion detector between plural different values according to the current values of ion pulses.

Preferably, according to the present invention, there is further provided a storage means for storing the output signal from the final ion detector indicative of ion pulses, together with information about the gain during the detection, such that these two kinds of information stored can be correlated.

Preferably, according to the present invention, a mirror portion (reflectron) is mounted before the final ion detector and behind the intermediate ion detector.

The aforementioned ion source is characterized in that it is of the orthogonal acceleration type and comprises an external ion source for continuously emitting ions, an ion reservoir for introducing the ion beam emitted from the external ion source, and an ion accelerating region for accelerating the ion beam from the ion reservoir in a pulsed manner in a direction crossing the direction of introduction of the ion beam by application of a pulsed voltage.

The external ion source described above is any one of an electron impact (EI) ion source, a chemical ionization (CI) ion source, a fast atom bombardment (FAB) ion source, an electrospray ionization (ESI) ion source, an atmospheric pressure chemical ionization (APCI) source, and an inductively coupled plasma (ICP) ionization source.

The aforementioned final ion detector may be made of either microchannel plates (MCPs) or microsphere plates (MSPs).

The present invention also comprises a method of performing mass analysis with a TOF mass spectrometer comprising the use of an ion source for emitting ion pulses, a TOF mass spectrometer region through which the ion pulses emerging from the ion source travel, and a final ion detector on which ion pulses that have traveled through said region a given distance impinge. This method starts with measuring the current values of the ion pulses which are emitted from the ion source and traveling toward the final ion detector and the elapsed times since departure from the ion source. The gain of the final ion detector is controlled according to the measured elapsed times and the measured current values in synchronism with the arrival of the ion pulses. Thus, saturation of the final ion detector due to the ion pulses is prevented.

Preferably, according to the present invention, an intermediate ion detector is mounted at the spatial focusing point for the ions in the TOF mass spectrometer portion to measure both current values of the ion pulses and the elapsed times since departure of the ions from the ion source.

Preferably, according to the present invention, the gain of the final ion detector is switched between plural different values according to the current values of the ion pulses.

Preferably, according to the present invention, there is provided a storage means for storing the output signal from the final ion detector indicative of the ion pulses, together with information about the gain during the detection, such that these two kinds of information stored can be correlated.

Preferably, according to the present invention, there is provided a mirror portion located before the final ion detector and behind the intermediate ion detector.

In one embodiment of the present invention, the aforementioned ion source is an orthogonal acceleration ion, source comprising an external ion source for emitting ions continuously, an ion reservoir for introducing the ion beam emitted from the external ion source, and an ion accelerating region for accelerating the ion beam in a pulsed manner from the ion reservoir in a direction crossing the direction of introduction of the ion beam.

The aforementioned external ion source is any one of an electron impact (EI) ion source, a chemical ionization (CI) ion source, a fast atom bombardment (FAB) ion source, an electrospray ionization (ESI) ion source, an atmospheric pressure chemical ionization (APCI) source, and an inductively coupled plasma (ICP) ionization source.

The aforementioned final ion detector may be made of either microchannel plates (MCPs) or microsphere plates (MSPs).

Other objects and features of the invention will appear in the course of the description thereof, which follows.

DESCRIPTION OF THE PREFERRED EMBODIMENTS

Figure 1:
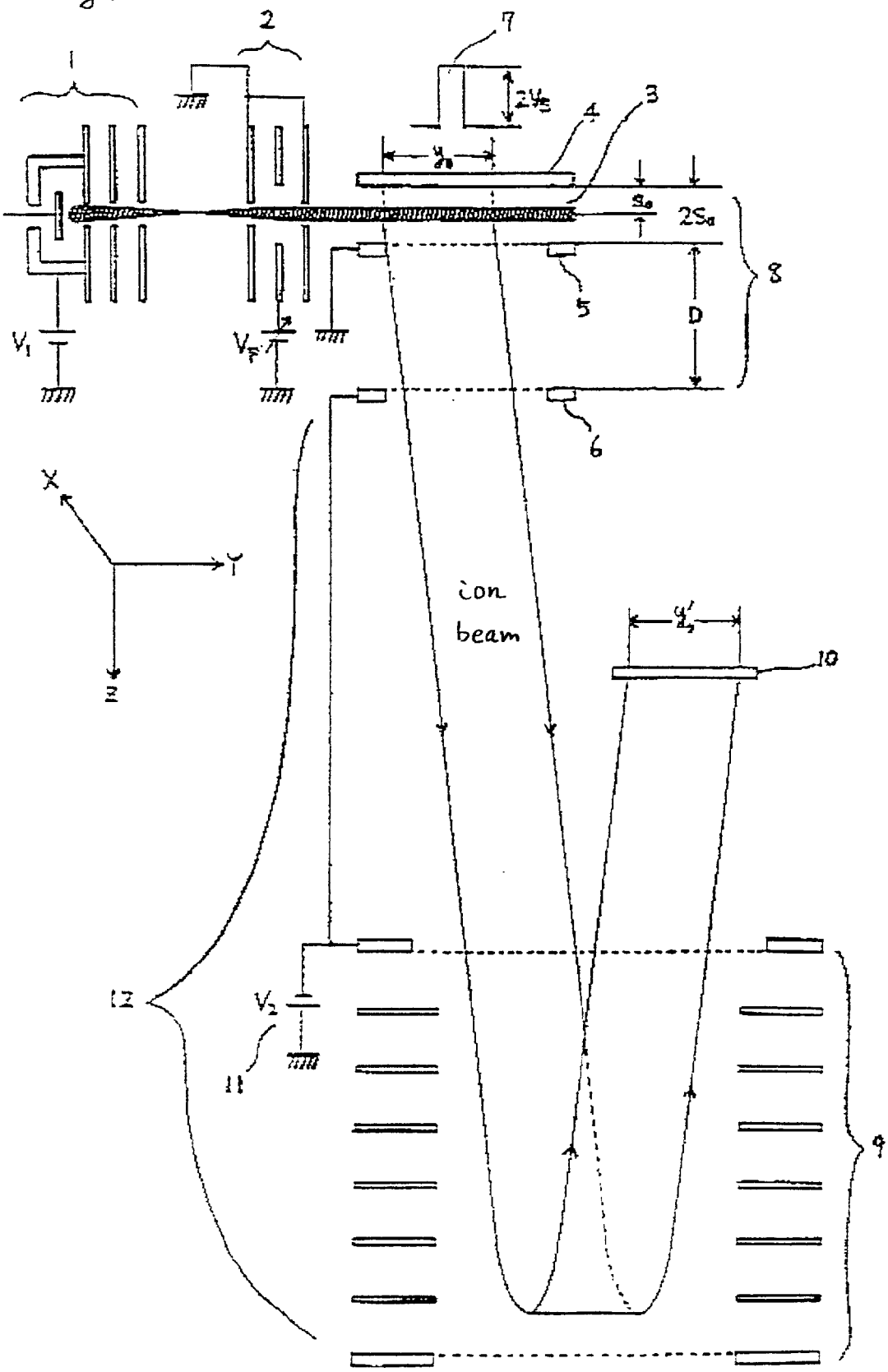
FIG. 1 is a diagram of the prior art reflectron orthogonal acceleration TOF mass spectrometer.
Figure 2:
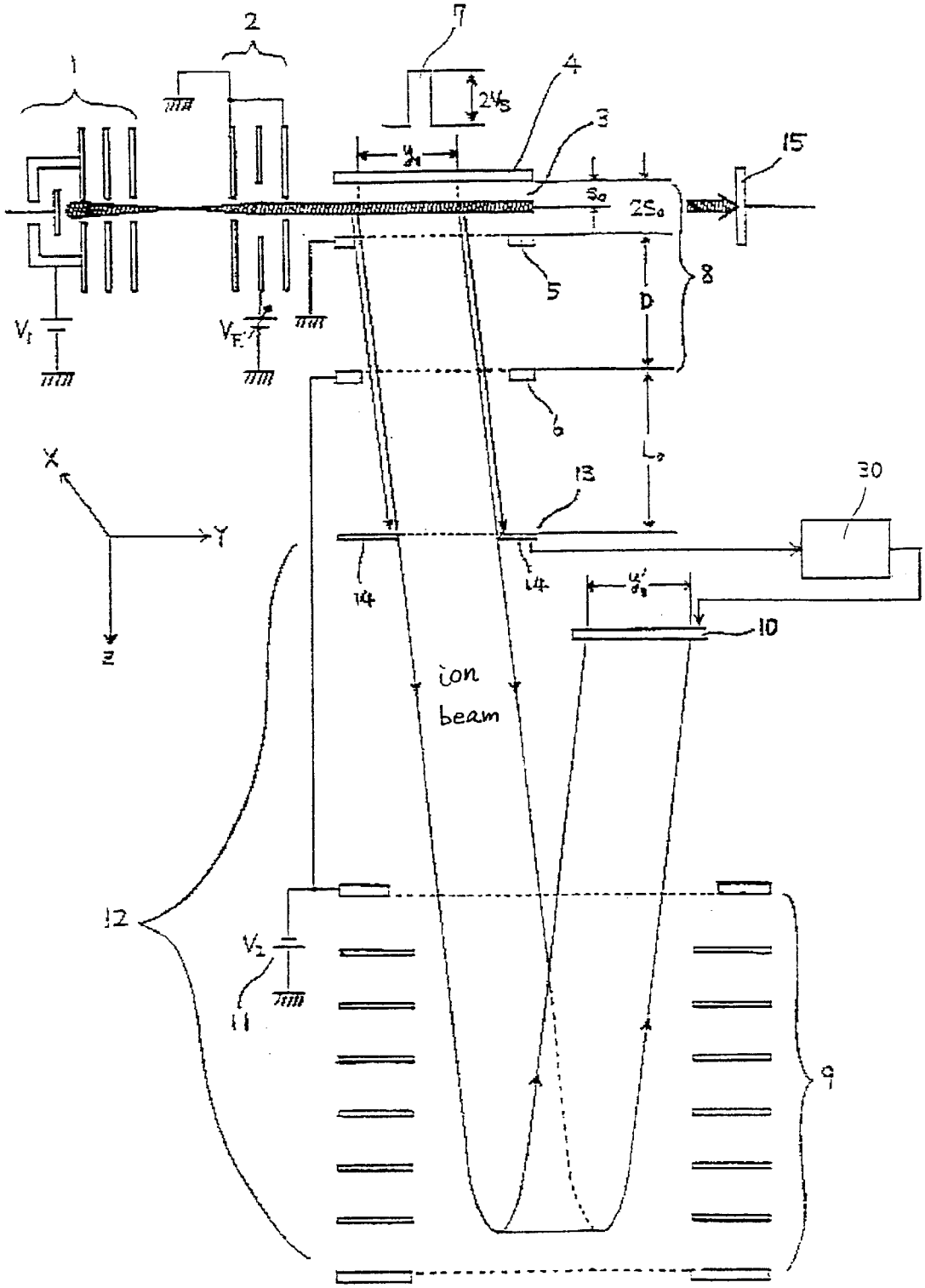
FIG. 2 is a diagram of a reflectron orthogonal acceleration TOF mass spectrometer in accordance with one embodiment of the present invention.

The preferred embodiments of the present invention are hereinafter described by referring to the drawings. FIG. 2 shows a reflectron orthogonal acceleration (OA) time-of-flight (TOF) mass spectrometer in accordance with the present invention. This instrument has an external ion source 1 for generating positive ions continuously by electron impact (EI), chemical ionization (CI), fast atom bombardment (FAB), electrospray ionization (ESI), inductively coupled plasma-mass spectrometry (ICP-MS), or other method.

An ion beam emitted from the external ion source 1 with a positive accelerating potential $V_1$ is focused in the z direction by a focusing lens 2 and introduced into an ion reservoir 3 having an effective length of $y_0$. A positive potential $V_F$ is applied to the focusing lens 2. The ion reservoir 3 is equipped with a push-out plate 4. The reservoir 3 is also provided with an ion extraction grid 5 and an exit grid 6 that are located opposite to the push-out plate 4. The extraction grid 5 is at ground potential. The exit grid 6 is at a negative potential. Thus, an electric field is developed to push out ions in a direction (z direction) crossing the direction of introduction of the ion beam (y direction).

If a push-out pulse 7 consisting of a positive voltage of $2V_s$ is applied to the push-out plate 4, a field gradient is momentarily produced in a region 8 that extends from the push-out plate 4 to the exit grid 6 across the ion extraction grid 5. This region 8 is known as the two-stage accelerating region. As a result, the ions in the ion reservoir 3 are simultaneously accelerated in the z direction and expelled as ion pulses. The ions are reflected by a mirror portion 9 mounted at an opposite position. Then, the ions travel toward a final ion detector 10 consisting of microchannel plates (MCPs) or the like.

Strictly, the ions have y-direction velocity components given when they are introduced into the ion reservoir 3. Therefore, if the ions undergo z-direction forces by the electric fields produced in the two-stage accelerating region 8, i.e., between the push-out plate 4 and the ion extraction grid 5 and between the grid 5 and the exit grid 6, the direction of travel is shifted to the y direction slightly from the z direction.

When the ions undergo the above-described acceleration, a given energy corresponding to the potential difference between the push-out plate 4 and the exit grid 6 is uniformly imparted to the ions and so ions of smaller masses have greater velocities when the acceleration is completed. Because of the velocity variations as described above, the ions are mass-dispersed while they are traveling through a reflectron TOF-MS spectrometer portion 12 placed at a negative potential $V_2$ by a spectroscopy power supply 11. Consequently, the ions are dispersed into ion pulses according to mass. As the ions having smaller mass-to-charge ratio (m/z; m: mass, z: valence number) reach the final ion detector 10 sooner, mass dispersion occurs. Thus, the ions can be observed as a mass spectrum.

One feature of the present invention is that an intermediate ion detector 14 is mounted at an ion spatial focusing point 13 located in the ion pulse trajectory going from the ion reservoir 3 to the mirror portion 9, by making use of time-focusing of individual ion pulses. Another feature is that a final ion detector gain control circuit 30 is mounted to control the gain of the final ion detector 10 optimally according to the current values of the individual ion pulses measured by the intermediate ion detector 14.

The intermediate ion detector 14 is centrally provided with a rectangular cutout. Most of individual ion pulses reaching the spatial focusing point 13 can pass through this intermediate ion detector 14 and travel through the reflectron TOF-MS spectrometer portion 12 safely. That is, only a small portion of the ion pulses reaching the spatial focusing point 13 hits the intermediate ion detector 14 and is detected.

The spatial focusing point 13 for ions is made coincident with the object point of the reflectron TOF-MS spectrometer portion 12. Ions having the same mass but different kinetic energies pass across the spatial focusing point 13 and then are time-dispersed again. They are reflected by the mirror portion 9 and temporally focused on the final ion detector 10 again. The temporal focusing ion pulses are measured as a mass spectrum. Usually, tandem microchannel plates stacked over each other are used as the final ion detector 10.

The ion reservoir 3 has a strike portion on which an ion detector 15 is mounted to monitor the total amount of ions introduced into the ion reservoir 3 after the ions are ionized by the external ion source 1.

The two-stage accelerating region 8 comprises a first accelerator portion between the push-out plate 4 and the ion extraction grid 5 and a second accelerator portion between the ion extraction grid 5 and the exit grid 6. Let $2S_0$ be the length of the first accelerator portion. Let D be the length of the second accelerator portion. Let $L_x$ be the distance between the exit grid 6 (or the end of the two-stage accelerating region) and the final ion detector 10. The flight time $t_{TOF}$ for ions to travel from the center $S_0$ of the first accelerator portion with length $2S_0$ to the final ion detector 10 is calculated in the manner described below.

It is assumed that ions traveling in the y direction from the external ion source 1 inside the ion reservoir 3 have an initial kinetic energy of $U_i=mv_i^2/2$. An ion push-out pulse voltage of $2V_s$ is applied to the ions. Under this condition, it is assumed that the first and second accelerator portions of the two-stage accelerating region are at potentials of $E_s$ and $E_d$, respectively.

The total kinetic energy after passage through the two-stage accelerating region is given by:

$$U=U_i+e\cdot S_0\cdot E_s+e\cdot D\cdot E_d \tag{3}$$

It is now assumed that ions leave the electric field Es in the first accelerator portion of the two-stage accelerating region and the electric field $E_d$ in the second accelerator portion at velocities of $v_s$ and $v_d$, respectively. These velocities of $v_s$ and $v_d$ are expressed as follows:

$$v_s=\sqrt{(2/m)}\cdot\sqrt{(U_{i+e\cdot S_{0E_s}})} \tag{4}$$

$$v_d=\sqrt{(2/m)}\cdot\sqrt{U} \tag{5}$$

Flight times of ions traveling through the accelerating fields $E_s$ and $E_d$ are given by:

$$t_s=\frac{m(v_s\pm v_i)}{e\cdot E_s}=\frac{\sqrt{(2m)}\cdot\left\{\sqrt{(U_i+e\cdot S_0\cdot E_s)}\pm\sqrt{U_i}\right\}}{e\cdot E_s} \tag{6}$$

$$t_d=\frac{m(v_d-v_s)}{e\cdot E_d}=\frac{\sqrt{(2m)}\cdot\left\{\sqrt{U}-\sqrt{(U_i+e\cdot S_0\cdot E_s)}\right\}}{e\cdot E_d} \tag{7}$$

The process subsequent to the acceleration of the ions by the two-stage accelerating region 8 is analyzed as follows. Let $L_0$ be the length of the free space between the exit grid 6 and the spatial focusing point 13. The flight time for the ions to go from the spatial focusing point 13 to the final ion detector 10 across the reflectron TOF-MS spectrometer portion 12 is given by:

$$t_{Lx}=\frac{\sqrt{(2m)}\cdot L_x}{\sqrt{U}}=\frac{\sqrt{(m/2)}\cdot L_x}{\sqrt{(U_i+e\cdot S_0\cdot E_s+e\cdot D\cdot E_d)}} \tag{8}$$

where $L_x$ is the calculated flight distance.

Accordingly, the total flight time $t_{TOF}$ of the ions is obtained by adding Eq. (8) to Eqs. (6) and (7) that express the flight times of the ions traveling through the two-stage accelerating region 8. Thus, we have:

$$t_{TOF}=t_s+t_d+t_{Lx} \tag{9}$$

Since the values given by Eqs. (6), (7), and (8) are in proportion to $\sqrt{m}$, where m is the mass of traveling ions, Eq. (9) is reduced, using an instrumental constant $K_x$, into the form:

$$T_{TOF}=K_x\cdot\sqrt{(m/2U)} \tag{10}$$

Where the intermediate ion detector 14 is placed at the spatial focusing point 13, the flight time $t_{F1}$ of the ions going from the intermediate point $S_0$ between the push-out plate 4 and the ion extraction grid 5 to the spatial focusing point 13 is rearranged by replacing the free-space length $L_x$ in Eq. (8) by the distance $L_0$ between the exit grid 6 and the spatial focusing point 13. That is, the flight time $t_{F1}$ can be calculated, using Eq. (11):

$$t_{F1}=t_s+t_d+t_{L0}=K_0\cdot\sqrt{(m/2U)} \tag{11}$$

where $t_{L0}$ is the flight time of ions to go from the exit grid 6 to the spatial focusing point 13 and $K_0$ is an instrumental constant.

Eliminating the term $\sqrt{(m/2U)}$ common to Eqs. (10) and (11) results in:

$$t_{TOF}=t_{F1}\cdot(K_x/K_0) \tag{12}$$

Figure 3:
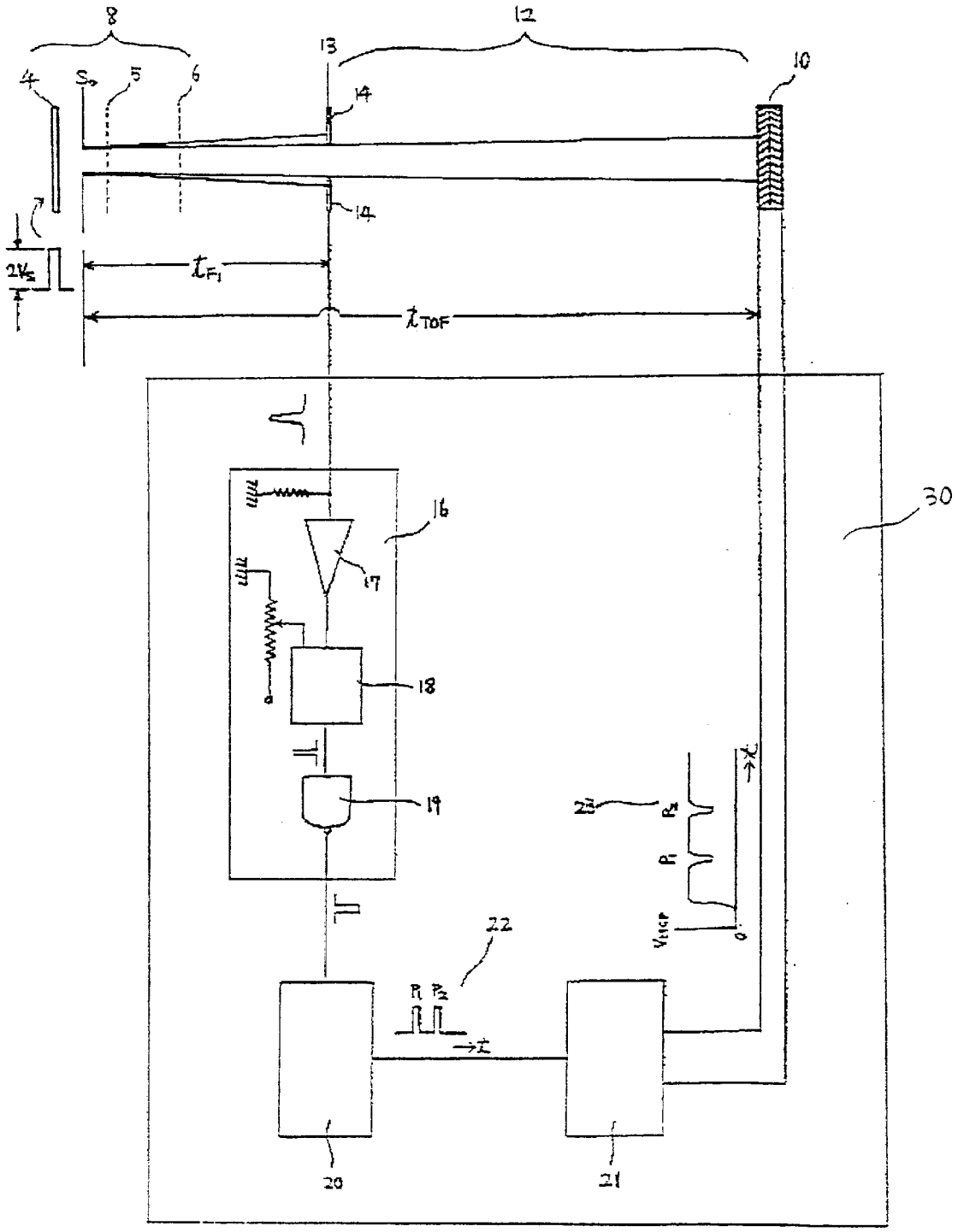
FIG. 3 is a block diagram of a microchannel plate (MCP) gain control circuit incorporated in a reflectron orthogonal acceleration TOF mass spectrometer in accordance with the present invention.

Based on the results described above, the intensities of arriving individual ion pulses are monitored by the intermediate ion detector 14 placed at this spatial focusing point 13. Then, the masses in of ions arriving at the intermediate ion detector 14 are calculated from Eq. (11), using a pulse-generating circuit as shown in FIG. 3 and the times $t_{F1}$ at which pulses are produced in response to arrival of the individual ion pulses. Then, using Eq. (10), arrival time $t_{TOF}$ of each individual ion pulse arriving at the final ion detector 10 is calculated to forecast the arrival time. Finally, the gain of each microchannel plate (MCP) is reset to prevent saturation of the microchannel plates before the individual ion pulses reach the microchannel plates of the final ion detector 10.

In Eqs. (10) and (11), those other than the masses m of the ions are known instrumental constants. It is possible to reset the gain of each microchannel plate quickly before the individual ion pulses reach the final ion detector 10 only if $\sqrt{m}$ is calculated quickly. The value of $\sqrt{m}$ is calculated to 5 significant digits. Accuracy sufficiently high for the present purpose is obtained if the value of $\sqrt{m}$ is calculated with accuracy of four significant digits.

A more straightforward method based on Eq. (12) is conceivable. First, the intensities of individual traveling ion pulses are monitored by the intermediate ion detector 14 placed at the spatial focusing point 13. Then, the arrival time $t_{F1}$ of each individual ion path arriving at the final ion detector 10 is forecast by calculation, using the pulse-generating circuit as shown in FIG. 3, the time $t_{F1}$ at which pulses are produced in response to arrival of individual ion pulses, and Eq. (12). Finally, the gain of each microchannel plate (MCP) is reset to prevent saturation of the microchannel plate before the individual ion pulses arrive at the final ion detector 10. In Eq. (12), those other than the time $t_{F1}$ are known instrumental constants. The gain of the microchannel plate can be reset quickly before ion pulses reach the final ion detector 10 only if the time $t_{F1}$ can be measured quickly.

FIG. 3 is a block diagram of the microchannel plate (MCP) gain control circuit. If a push-out pulse 7 of $2V_s$ is applied to the push-out plate 4 of the two-stage accelerating region 8, ions inside the ion reservoir start from the intermediate point $S_0$ between the push-out plate 4 and the ion extraction grid 5. After traveling through the two-stage accelerating region 8, the ions arrive as temporal focusing ion pulses at the spatial focusing point 13. Some of the ion pulses are detected by the intermediate ion detector 14 located at the spatial focusing point 13. The output signal from the detector 14 is amplified by an amplifier 17 in a pulse circuit 16. if the output from the amplifier 17 exceeds a threshold value at which a discriminator 18 is set, the discriminator 18 produces a pulse to an MCP power supply control circuit 20 via an inverting circuit 19.

The final ion detector gain control circuit 30 measures the time $t_{F1}$ between the moment when the push-out pulse 7 is produced and the moment when the inverting circuit 19 produces a pulse. The final ion detector gain control circuit 30 calculates the value of $\sqrt{m}$ of each ion arriving as ion pulses $P_1$, $P_2$, and $P_3$ from the result of the measurement, by means of the MCP power supply control circuit 20. The value of $\sqrt{m}$ is substituted into Eqs. (10) and (11). Alternatively, the measured time $t_{F1}$ is directly substituted into Eq. (12). Thus, forecast arrival times $t_{TOF}$ of individual ions arriving at the final ion detector 10 are found.

At these forecast times, the MCP power supply control circuit 20 causes an MCP voltage source 21 to produce a pulse sequence 22. The output voltage from the MCP voltage source 21 is lowered before individual pulses arrive at the final ion detector 10 (i.e., the microchannel plates), thus lowering the gain of each microchannel plate. When a given time passes since the arrival times $t_{TOF}$ of individual ions, the output voltage from the MCP voltage source 21 is increased to return the gain of the MCP to its original value. By operating the MCP gain control circuit in this way, saturation of the final ion detector 10 can be prevented even if intense ion pulses travel from the ion source. The manner in which the output voltage $V_{MCP}$ from the MCP voltage source 21 varies with time is indicated by 23.

Figures 4A, 4B, 4C, 4D, 4E, 4F, 4G:
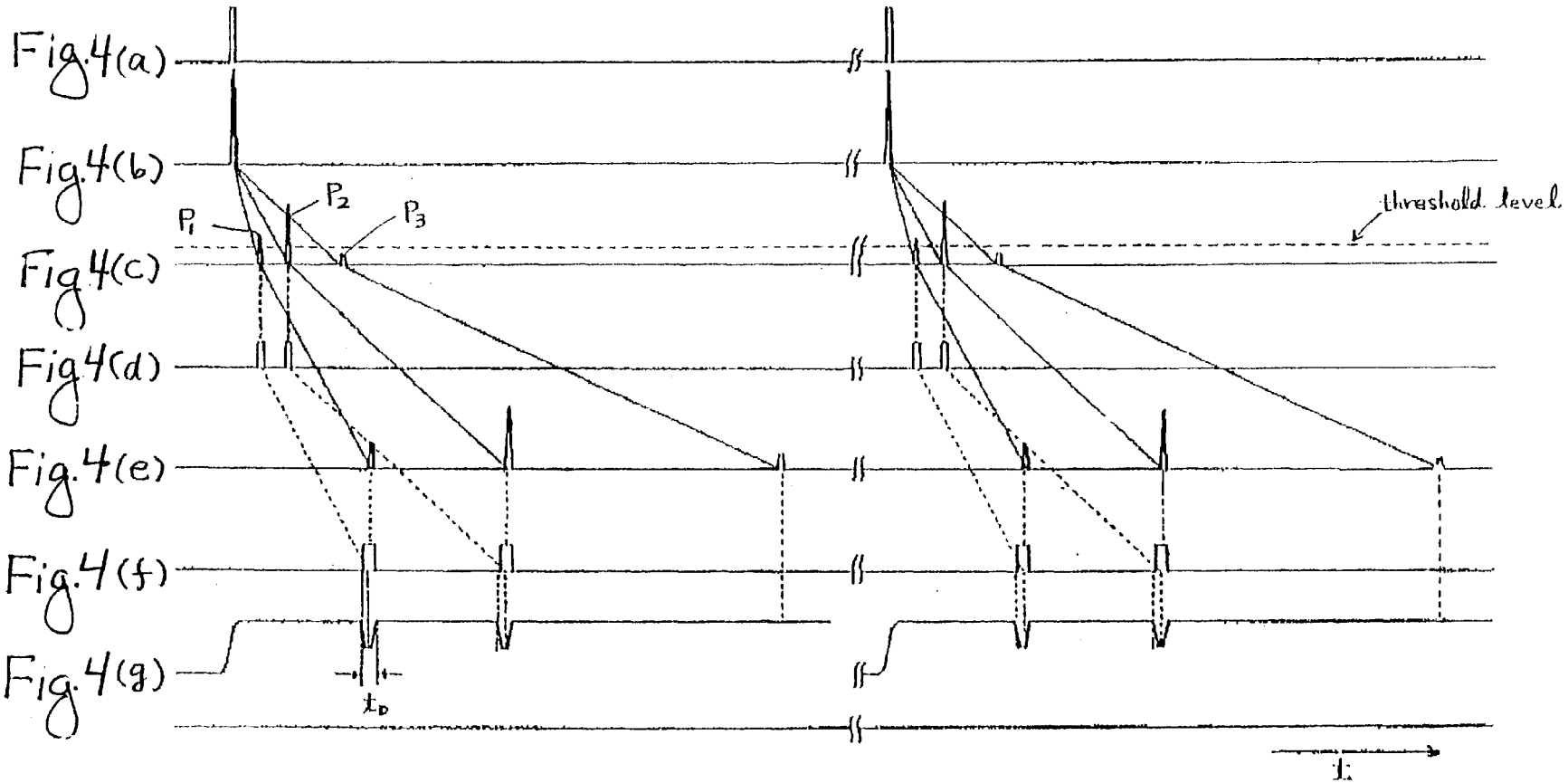
FIGS. 4(*a*) to 4(*g*) are timing charts illustrating the operation of various portions of the microchannel plate (MCP) gain control circuit shown in FIG. 3.
Figure 1:
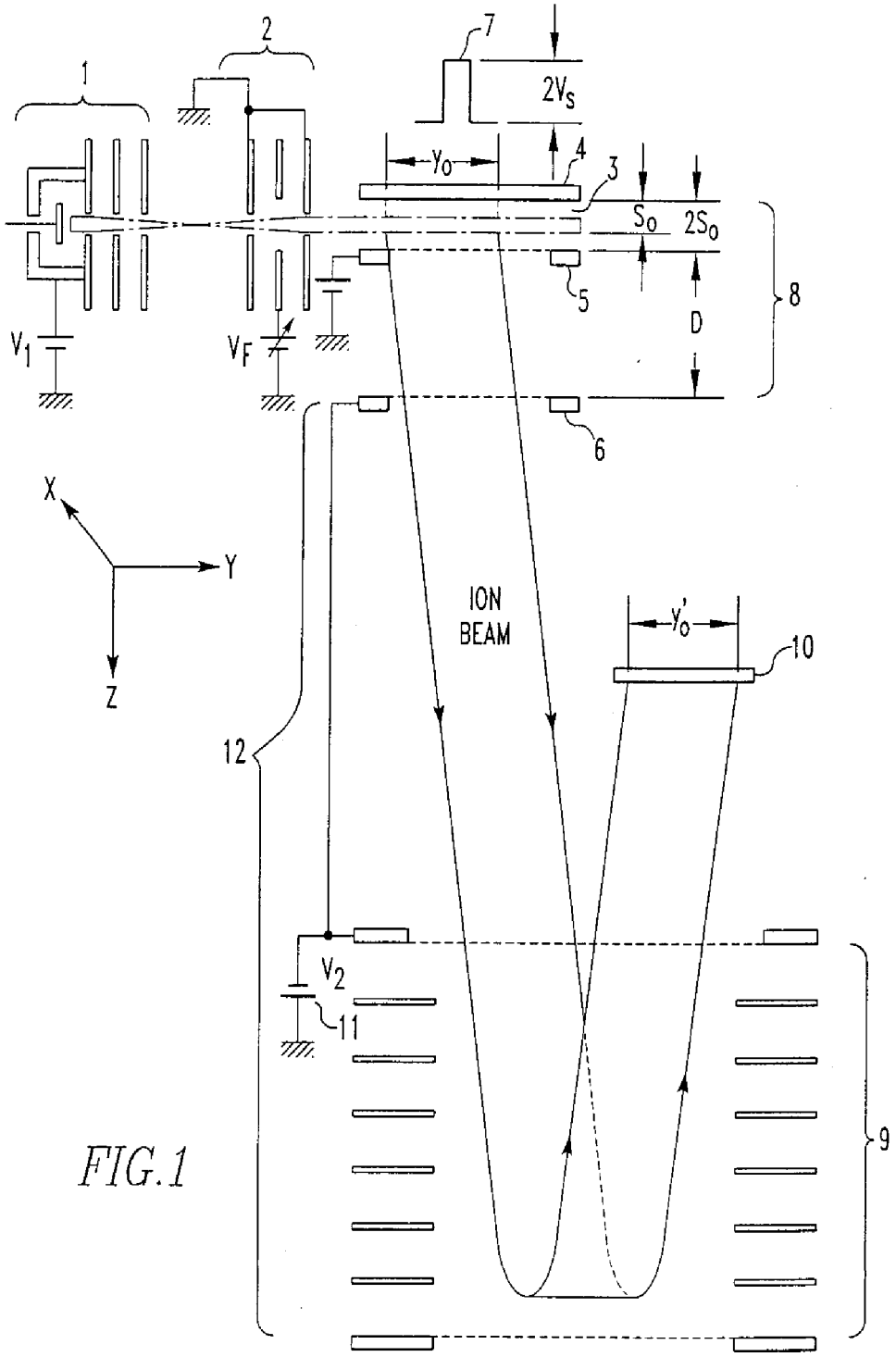
Figure 2:
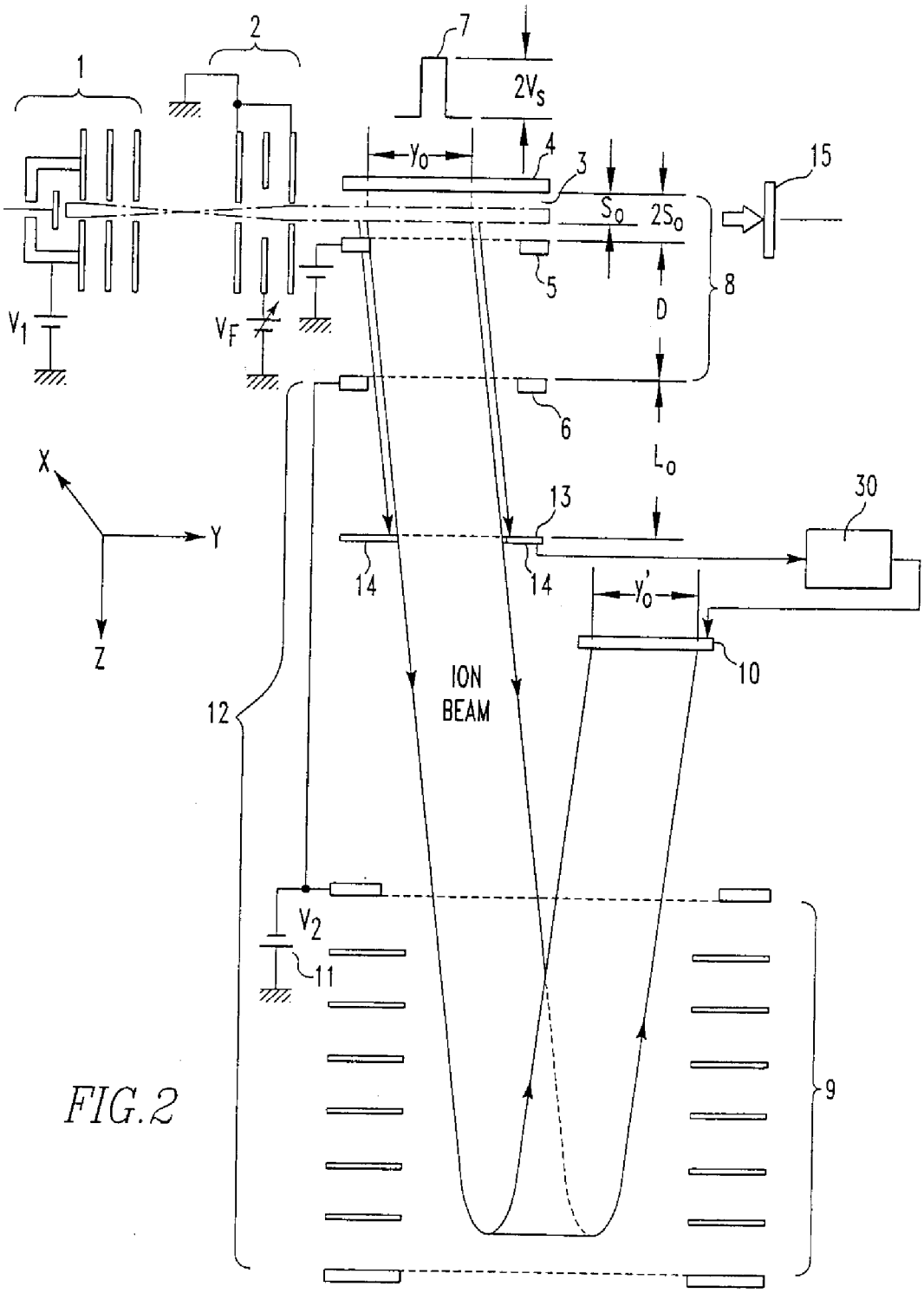
Figure 3:
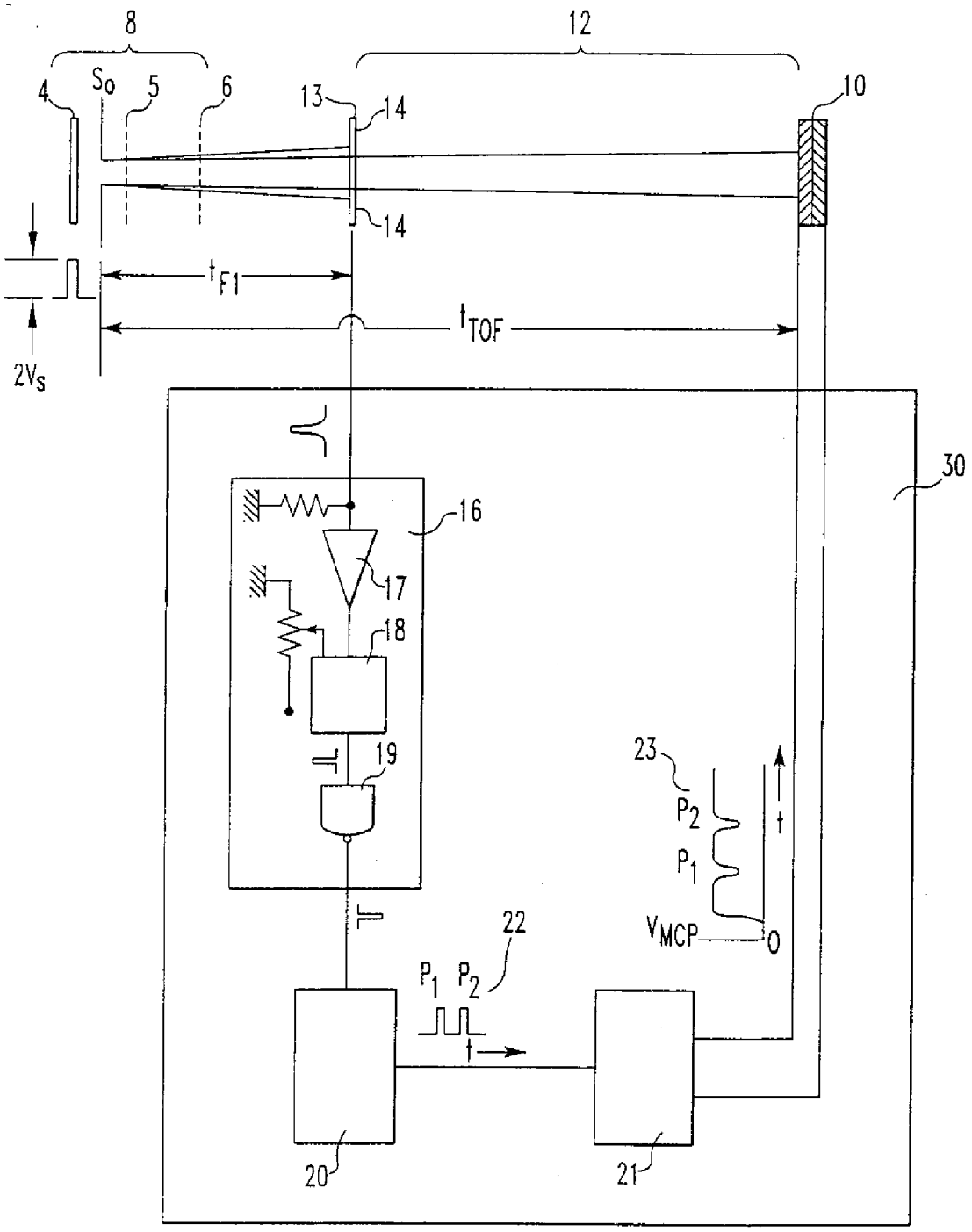
Figures 4A, 4B, 4C, 4D, 4E, 4F, 4G:
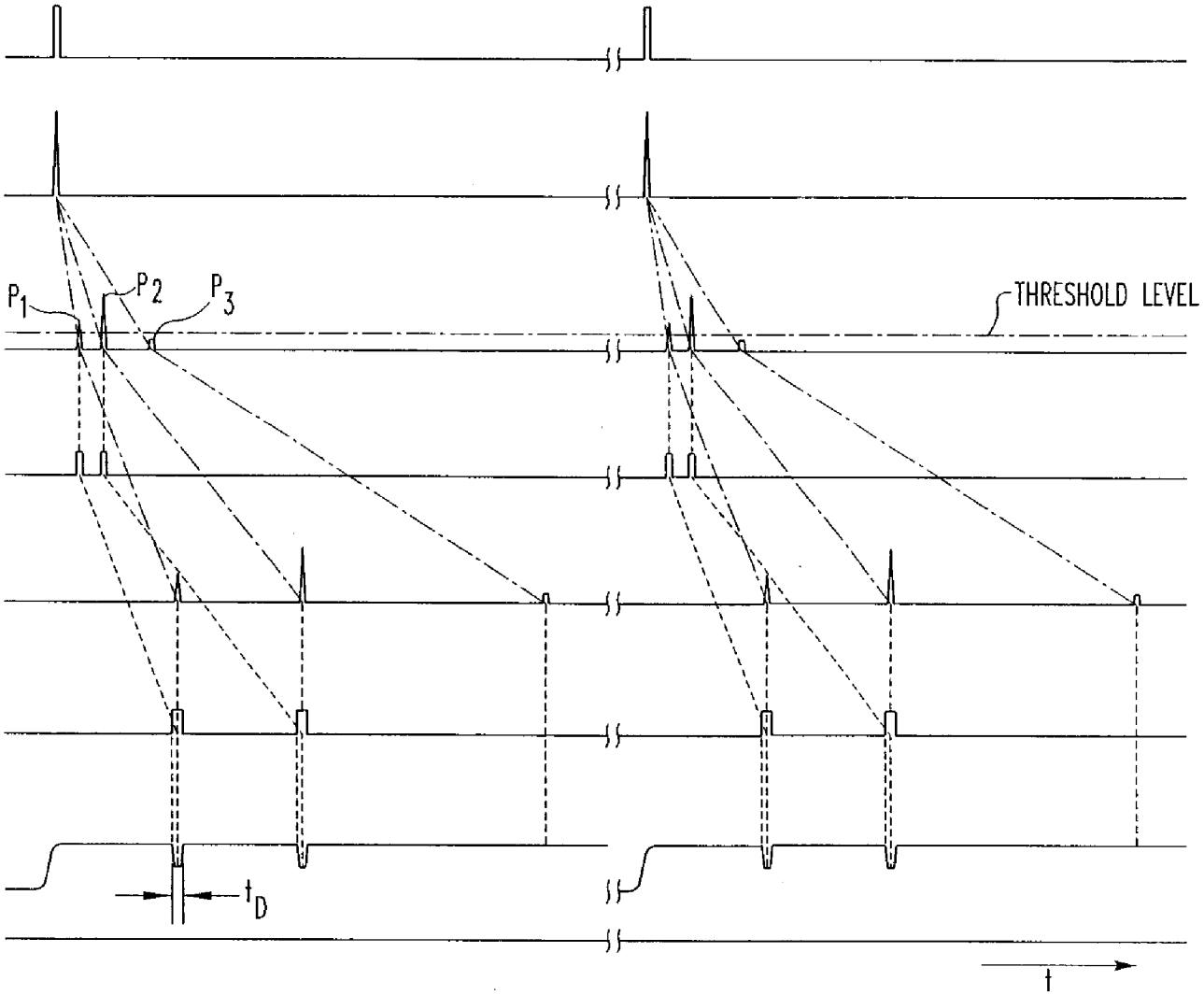

FIGS. 4(*a*)–4(*g*) are timing charts showing the timing of operation of various portions. FIG. 4(*a*) indicates the time at which the push-out pulse of $2V_s$ is applied; FIG. 4(*b*) indicates the time at which an ion pulse is produced; FIG. 4(*c*) indicates the flight time $t_{F1}$ of each individual ion pulse until the ion pulses $P_1$, $P_2$, and $P_3$ are detected by the intermediate ion detector 14 located at the spatial focusing point 13; FIG. 4(*d*) indicates the timing of a pulse sequence produced to the MCP power supply control circuit 20 from the inverting circuit 19 in response to the signals of the ion pulses $P_1$, $P_2$, and $P_3$ detected by the intermediate ion detector 14; FIG. 4(*e*) indicates the elapsed time tTOE until the ion pulses $P_1$, $P_2$, and $P_3$ arrive at the final ion detector 10; FIG. 4(*f*) indicates the timing of the pulse sequence 22 produced to the MCP voltage source 21 from the MCP power supply control circuit 20 to control the voltage source 21; and FIG. 4(*g*) indicates the manner in which the gain of a microchannel plate varies with time, the gain being set according to the output voltage $V_{MCP}$ from the MCP voltage source 21.

It is assumed that $P_1$ and $P_2$ of the aforementioned pulses $P_1$, $P_2$, and $P_3$ are ion pulses that are more intense than the threshold level above which the microchannel plates (MCP) of the final ion detector 10 saturate, while the pulse $P_3$ is a feeble ion pulse lower than the threshold level. Of pulse signals produced from the intermediate ion detector 14, the pulses $P_1$ and $P_2$ might saturate the microchannel plates. Therefore, the inverting circuit 19 produces a pulse signal to the MCP power supply control circuit 20 to prevent saturation of the microchannel plates. However, the pulse $P_3$ is unlikely to saturate the microchannel plates and so the inverting circuit 19 produces no pulse signal.

The inverting circuit 19 produces the pulse sequence 22 (the same as FIG. 4(*f*)) to the MCP voltage source 21 via the MCP power supply control circuit 20. The dwell time $t_D$ of each pulse extends $t_D/2$ on either side of the flight time $t_{TOF}$ of each individual ion pulse. Even if it is assumed that the dwell time $t_D$ is about 5 times as long as $\Delta t$ in Eq. (1), the width of the dwell time $t_D$ is less than 50 ns. If the response time of a quickly operating switch for the MCP voltage source 21 is taken into consideration and the dwell time $t_D$ is assumed to be 10 times as long as the pulse width $\Delta t$, i.e., 100 ns, then mass spectral peaks in a range of several dalton are omitted or measured with low gain, provided that the masses m of the ion pulses are less than hundreds of dalton. That is, the influence is limited. In summary, the width of the dwell time $t_D$ should be set to a value best adapted for the TOF-MS instrument.

Let $G_A$ be the initially set gain of each microchannel plate. Let $G_B$ ($=k \cdot G_A$, k 1) be the gain of the microchannel plate when MCP voltage $V_{MCP}$ is lowered in anticipation of impingement of intense ion pulses. When the given time $t_D/2$ passes since impingement of an ion pulse, the gain $G_B$ is automatically reset to $G_A$. During this process, the factor of drop k ($=G_B/G_A$) of the gain of the microchannel plate (MCP) may be set to a desired value between 1/10 and 1/1000.

The output signal from the MCP detector 10 indicative of each ion pulse is stored in memory, together with a signal indicating whether the gain is $G_A$ or $G_B$ during detection. When the intensity of the output signal from the detector is discerned, the gain at the time of detection is taken into account.

If plural pulse circuits each having the same structure as the pulse circuit 16 of FIG. 3 are provided in parallel, and if their respective discriminators 18 are set to different values, the factor of drop k of the gain can be stepped downward so as to assume different values in succession. In this case, if the stepped-down factor of drop k of the gain of the final ion detector 10 is previously stored in a storage means, and if the intensity of a signal indicating an actually measured mass spectrum is corrected according to the stored value of k, then variations of the signal intensity indicating the mass spectrum arising from variations in the gain of the final ion detector 10 can be corrected automatically. In consequence, highly quantitative measurements can be performed. Conversely, if ion pulses arriving from the ion source via the two-stage accelerating region 8 are very weak, the factor of drop k of the gain is set to less than unity. In this case, the gain of the final ion detector 10 is stepped upward. The sensitivity of the final ion detector 10 to ions can be raised within a range in which saturation does not occur.

The ratio of the amount of ions hitting the final ion detector 10 to the amount of ions hitting the intermediate ion detector 14 is not always fixed. The ratio may be set to an appropriate value between 1:10 and 1:100, depending on the TOF-MS instrument.

A high-speed, high-voltage electric circuit is necessary to lower and restore the gain of each microchannel plate at good timing and quickly, immediately before and after the moment when ion pulses enter the microchannel plates forming the final ion detector. The MCP voltage can be varied in increments of 500 to 1 kV quickly by switching the gain at a rate of 5 to 10 ns, using a semiconductor device, such as a high-speed MOSFET switch withstanding high voltages without using a mercury-contact relay or a Q-switch.

In the present embodiment, a reflectron orthogonal acceleration (OA) time-of-fight (TOF) mass spectrometer is taken as an example. It is to be noted that the present invention is not limited to reflectron OA-TOF mass spectrometers. The invention is also applicable to a TOF mass spectrometer using pulsed ionization, though the instrument is restricted to the type using two- or three-stage acceleration and a spatial focusing point made coincident with the object point of the TOF-MS spectrometer portion. Furthermore, the TOF-MS spectrometer portion can be used in an instrument of the electrostatic sector field type.

In addition, the final ion detector is not limited to an assembly of microchannel plates (MCPs). Microsphere plates (MSPs) or the like may also be used. The microsphere plate is cheaper than the microchannel plate and is not made of very thin capillary tubes bundled together, such as a microchannel plate. The microsphere plate diffusely reflects electrons by gaps among numerous spherical particles.

As described thus far, an orthogonal acceleration (OA) time-of-flight (TOF) mass spectrometer in accordance with the present invention uses an intermediate ion detector located at the spatial focusing point in the TOF-MS spectrometer portion to measure the current values of ion pulses arriving from an external ion source and the elapsed times since the start of travel of the ion pulses. Information obtained by the measurement is fed back to the final ion detector. Thus, the gain of the final ion detector is controlled before the ion pulses reach the final ion detector, thus circumventing saturation of the final ion detector; otherwise, a dead time arising from the saturation would eliminate parts of the mass spectrum. Furthermore, decrease of the life of the final ion detector itself can be prevented.

Having thus described my invention with the detail and particularity required by the Patent Laws, what is desired protected by Letters Patent is set forth in the following claims.

What is claimed is:

1. A time-of-flight (TOF) mass spectrometer comprising:

an ion source for emitting ion pulses;

a time-of-flight mass spectrometer region through which the ion pulses emitted from the ion source travel;

a final ion detector for detecting incident ion pulses which have traveled a given distance through said region and have been dispersed into plural ion pulses according to flight velocity;

a flight time-measuring portion for measuring times taken for the dispersed ion pulses to reach the final ion detector since departure from the ion source;

an intermediate ion detector mounted in said time-of-flight mass spectrometer region and acting to detect current values of said dispersed ion pulses before reaching the final ion detector;

a measuring means for measuring elapsed times of the dispersed ion pulses reaching the intermediate ion detector since departure from the ion source;

means for forecasting flight time at which the dispersed ion pulses will reach the final ion detector based on the measured elapsed times since the departure from the ion source; and a saturation-preventing means for controlling the gain of the final ion detector according to the current values of the dispersed ion pulses detected by the intermediate ion detector and according to the forecast times of arrival of the dispersed ion pulses at the final ion detector in step with arrival of the dispersed ion pulses to prevent the dispersed ion pulses from saturating the final ion detector.

2. The time-of-flight mass spectrometer of claim 1, wherein said intermediate ion detector is located at an ion spatial focusing point in the time-of-flight mass spectrometer portion.

3. The time-of-flight mass spectrometer of claim 1 or 2, wherein said saturation-preventing means switches the gain of said final ion detector between plural different values according to the current values of the ion pulses.

4. The time-of-flight mass spectrometer of claim 3, further comprising a storage means for storing an output signal from said final ion detector indicative of the ion pulses together with information about the gain during detection such that the stored signal is correlated to the stored information about the gain.

5. The time-of-flight mass spectrometer of claim 1 or 2, wherein there is further provided a mirror portion before said final ion detector and behind said intermediate ion detector.

6. The time-of-flight mass spectrometer of claim 1 or 2, wherein said ion source is an orthogonal acceleration ion source comprising:

an external ion source for emitting ions continuously;

an ion reservoir for introducing an ion beam emitted from said external ion source; and an ion accelerating region for accelerating the ion beam in a pulsed manner from said ion reservoir in a direction crossing the direction of introduction of the ion beam.

7. The time-of-flight mass spectrometer of claim 6, wherein said external ion source is any one of an electron impact (EI) ion source, a chemical ionization (CI) ion source, a fast atom bombardment (FAB) ion source, an electrospray ionization (ESI) ion source, an atmospheric pressure chemical ionization (APCI) source, and an inductively coupled plasma (ICP) ionization source.

8. The time-of-flight mass spectrometer of claim 1 or 2, wherein said final ion detector is made of microchannel plates (MCPs) or microsphere plates (MSPs).

9. A method of performing a mass analysis with time-of-flight mass spectrometer comprising an ion source for emitting ion pulses, a time-of-flight mass spectrometer region through which the ion pulses emitted from said ion source travel, and a final ion detector on which ions traveled a given distance through said region impinge, said method comprising the steps of:

measuring current values of said ion pulses and their elapsed times since departure from the ion source in said time-of-flight mass spectrometer portion before the ion pulses emitted from said ion source reach the final ion detector; and controlling gain of said final ion detector in synchronism with arrival of the ion pulses according to the measured elapsed times and current values of the ion pulses, thus preventing saturation of said final ion detector.

10. The method of claim 9, wherein an intermediate ion detector is mounted at an ion spatial focusing point in said time-of-flight mass spectrometer portion to measure the current values of the ion pulses and the elapsed times since departure of the ion pulses from the ion source simultaneously.

11. The method of claim 9 or 10, wherein the gain of said final ion detector is switched between plural different values according to the current values of the ion pulses to prevent saturation of said final ion detector.

12. The method of claim 11, wherein there is further provided a storage means for storing an output signal from said final ion detector indicative of the ion pulses together with information about the gain during detection such that the stored signal is correlated to the stored information about the gain.

13. The method of claim 9 or 10, wherein there is further provided a mirror portion before said final ion detector and behind said intermediate ion detector.

14. The method of claim 9 or 10, wherein said ion source is an orthogonal acceleration ion source comprising:

an external ion source for emitting ions continuously;

an ion reservoir for introducing an ion beam emitted from said external ion source; and an ion accelerating region for accelerating the ion beam in a pulsed manner from said ion reservoir in a direction crossing the direction of introduction of the ion beam.

15. The method of claim 14, wherein said external ion source is any one of an electron impact (EI) ion source, a chemical ionization (CI) ion source, a fast atom bombardment (FAB) ion source, an electrospray ionization (ESI) ion source, an atmospheric pressure chemical ionization (APCI) source, and an inductively coupled plasma (ICP) ionization source.

16. The method of claim 9 or 10, wherein said final ion detector is made of microchannel plates (MCPs) or microsphere plates (MSPs).

* * * * *

UNITED STATES PATENT AND TRADEMARK OFFICE

CERTIFICATE OF CORRECTION

PATENT NO. : 6,674,068 B1
DATED : January 6, 2004
INVENTOR(S) : Yoshihiro Kammei It is certified that error appears in the above-identified patent and that said Letters Patent is hereby corrected as shown below:

Drawings,
Replace the printed drawing sheets with the attached drawing sheets.

Signed and Sealed this

Ninth Day of November, 2004

JON W. DUDAS
*Director of the United States Patent and Trademark Office*

THRESHOLD LEVEL
P1
P2
P3
tD
t